US005255743A

United States Patent [19]

Adam et al.

[11] Patent Number: 5,255,743

[45] Date of Patent: Oct. 26, 1993

[54] SIMPLIFIED WELLHEAD CONNECTOR

[75] Inventors: Leslie J. Adam; Walter J. Lacey, both of Aberdeen, Scotland; Egil E. Rebne, Stavanger, Norway

[73] Assignee: ABB Vetco Gray Inc., Houston, Tex.

[21] Appl. No.: 810,222

[22] Filed: Dec. 19, 1991

[51] Int. Cl.[5] ..... E21B 33/038

[52] U.S. Cl. ..... 166/345; 166/368; 285/18

[58] Field of Search ..... 166/344, 345, 346, 368; 285/3, 18, 24, 39

[56] References Cited

U.S. PATENT DOCUMENTS

| | | | |
|---|---|---|---|
| 4,453,745 | 6/1984 | Nelson . | |
| 4,478,287 | 10/1984 | Hynes et al. | 166/345 |
| 4,526,406 | 7/1985 | Nelson . | |
| 4,653,778 | 3/1987 | Alandy | 285/18 |
| 4,696,493 | 9/1987 | Brammer | 166/345 X |
| 4,819,967 | 4/1989 | Calder et al. . | |
| 4,856,594 | 8/1989 | Jennings | 166/345 X |
| 4,893,842 | 1/1990 | Brammer | 285/39 X |
| 4,902,044 | 2/1990 | Williams et al. | 166/344 X |
| 4,962,952 | 10/1990 | Pallini, Jr. et al. . | |
| 4,976,458 | 12/1990 | Hosie et al. | 285/24 |

OTHER PUBLICATIONS

Conoco Heidrun TLP-Tieback Connector existing design.

*Primary Examiner*—Ramon S. Britts
*Assistant Examiner*—Frank S. Tsay
*Attorney, Agent, or Firm*—James E. Bradley

[57] ABSTRACT

A subsea wellhead connector has a stress joint which abuts the rim of a wellhead housing. A body is carried by the stress joint and extends over the wellhead housing. The body carries dogs for moving into an engaged position with a profile on the exterior of the wellhead housing. A seal locates between the rim and the downward facing shoulder of the stress joint.

16 Claims, 3 Drawing Sheets

SIMPLIFIED WELLHEAD CONNECTOR

BACKGROUND OF THE INVENTION

1. Field of the Invention

This invention relates in general to tieback wellhead connectors for connecting to a subsea wellhead.

2. Description of the Prior Art

Subsea wells normally have a wellhead housing, which is a large tubular member located at the sea floor. Casing will be supported in the wellhead housing by a casing hanger. In one type of well, a riser will extend upward from the subsea wellhead housing to a platform. A Christmas tree will be mounted at the platform for controlling the flow of the produced fluid. A tieback wellhead connector will connect the lower end of the riser to the wellhead housing.

An external wellhead connector normally has a body that bolts to the lower end of the riser, which typically is a stress joint. The stress joint is a tubular member that is tapered for handling bending stress due to wave and current motion. Tension bolts extend through an external flange of the stress joint into the body to secure the body to the stress joint. The body has a cylindrical portion that extends around the wellhead housing. The body has a downward facing shoulder that lands on the upper rim of the wellhead housing. A seal locates at the shoulder between the wellhead housing and the wellhead connector body.

A locking element, preferably a set of dogs, will be pushed out from a retracted position into engagement with an external profile on the wellhead housing. A seal sub secures to the lower end of the stress joint and extends sealingly into the bore of the casing hanger in the wellhead housing. A flange of the seal sub is compressed between a portion of the body and the lower end of the stress joint.

The dogs are pushed into the engaged position by a cam ring. The cam ring connects to rods which extend through holes in the body up to an actuator ring. The running tool engages the actuator ring to push the cam ring downward for moving the dogs to the engaged position. For later removal of the wellhead connector, the running tool will lift the actuator ring, which in turn lifts the cam ring.

While this type of connector is workable, it would be desirable to eliminate some of the seals and to reduce the weight and number of components.

SUMMARY OF THE INVENTION

In this invention, the stress joint of the connector assembly engages the upper rim of the wellhead housing, rather than the connector body as in the prior art. The seal locates between the stress joint and the wellhead housing, rather than between the body and the wellhead housing. The seal sub seals within a counterbore in the stress joint and is free of contact with the body.

In the preferred embodiment, the connector body has a downward facing shoulder that engages an upward facing shoulder or flange on the stress joint. A locking member carried by the body moves outward to a retracted position, and inward into an engaged position with the grooved profile on the exterior of the wellhead housing. A cam ring will push the locking element to the engaged position. The engagement of the dogs pulls downward on the body, which in turn pushes downward on the stress joint to energize the seal.

The running tool engages the cam ring directly, as the actuator ring of the prior art type is eliminated. The running tool reacts against a reaction shoulder on the body.

DETAILED DESCRIPTION OF THE INVENTION

Figure 1:
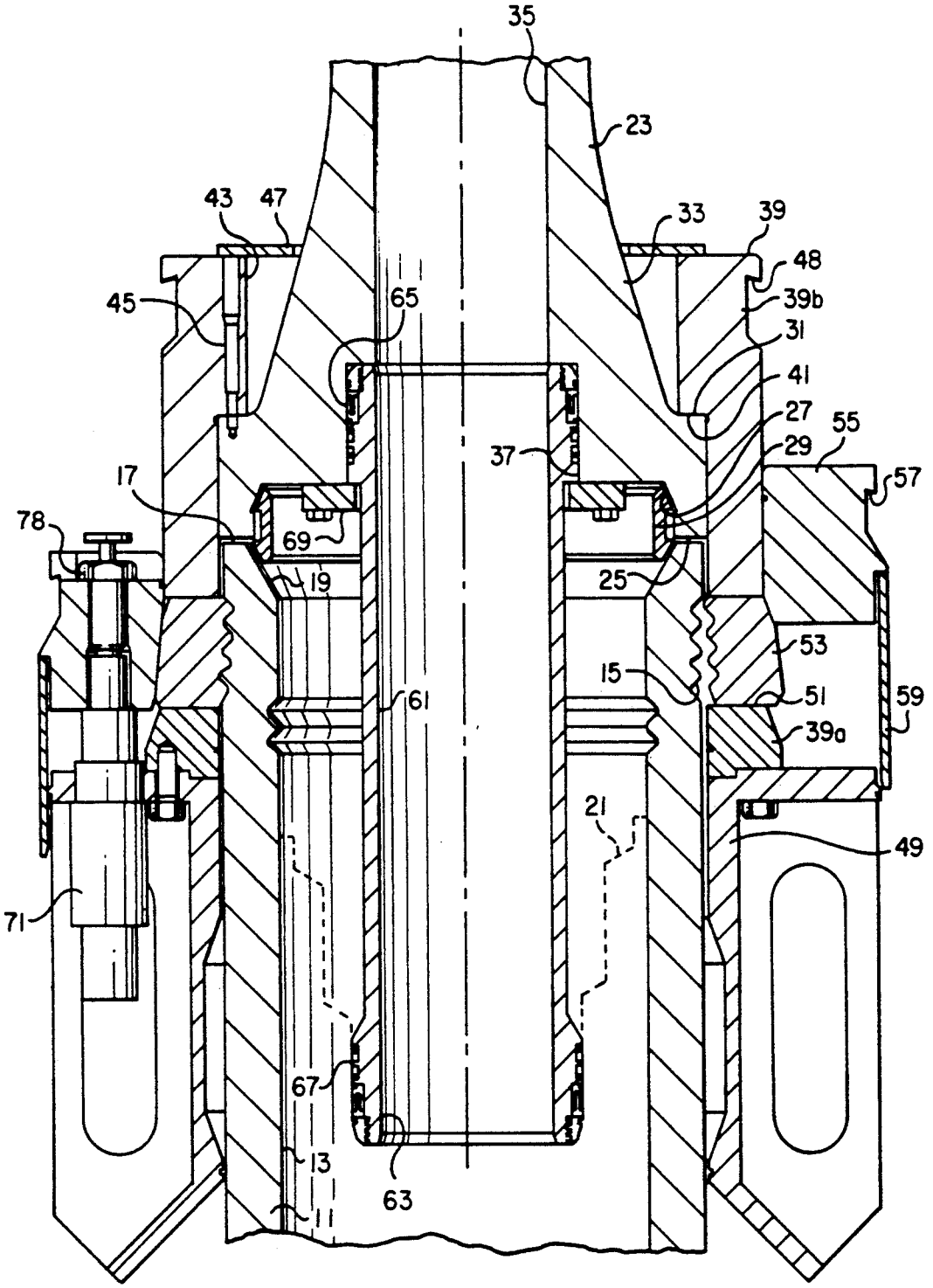
FIG. 1 is a vertical sectional view of a wellhead connector constructed in accordance with this invention, showing on the left an engaged position, and on the right a disengaged position.

Referring to FIG. 1, wellhead housing is conventional. Wellhead housing 11 is located on a sea floor and secured to a string of conductor pipe (not shown) which extends into the well. Wellhead housing 11 has an axial bore 13 and an external grooved profile 15. The profile 15 has conical downward facing flanks. A rim 17 is at the upper end of wellhead housing 11. Rim 17 has an internal bevel 19 that is conical. A conventional casing hanger 21, shown by dotted lines, will be installed in bore 13. Casing hanger 21 secures to the upper end of a string of casing (not shown) extending into the well.

A riser string of a tieback connector will connect to the wellhead housing 11. The riser string (not shown) extends upward to a surface platform A Christmas tree (not shown) will be located at the upper end of the riser at the surface platform for controlling fluids produced through the well. A stress joint 23 forms the lower end of the riser. Stress joint 23 is a tubular member with an upper end that secures to the riser and a lower end which secures to wellhead housing 11.

In this invention, stress joint 23 has a downward facing shoulder 25 on its lower end that abuts the rim 17 of wellhead housing 11. Downward facing shoulder 25 has an internal bevel 27 that is conical. A conventional metal seal 29 is secured to stress joint 23 in contact with bevel 27. When downward facing shoulder 25 abuts rim 17, seal 29 will be energized or deformed between bevels 19 and 27.

Stress joint 23 has a flange or upward facing shoulder 31 at its periphery. Shoulder 31 is circular, and is located at the lower end of a tapered exterior section 33. Tapered section 33 is generally conical and converges in an upward direction. Stress joint 23 has an axial passage 35 with a counterbore 37 formed at the lower end.

A body 39 is carried by stress joint 23. Body 39 has a lower cylindrical portion **39*a* that extends down over and around wellhead housing 11. Body 39 has an upper portion 39*b* that extends upward past the stress joint upward facing shoulder 31**. A downward facing shoulder 41 in the interior of body 39 forms the junction between the upper section 39*b* and the lower section 39*a*. Downward facing shoulder 41 abuts the stress joint upward facing shoulder 31.

Body 39 has a cylindrical inner wall 43 in its upper section 39*b*. Because of the tapered exterior 33, an annular conical space exists between exterior section 33 and inner wall 43. A plurality of vertical bolts 45 extend from body upper section 39*b* into stress joint 23 at the upward facing shoulder 31. Bolts 45 engage threads only in shoulder 31 There are no threads in the holes in the body 39 for bolts 45. Consequently, a downward force imposed on the body 39 will transmit directly to stress joint shoulder 31, and not through any threads of bolts 45. A rubber gasket 47 mounts to the upper end of body 39 and encircles stress joint 23 to keep debris out of the interior of body 39. Stress joint 23 is capable of moving slightly in lateral directions relative to body 39 due to bending moments on the riser string. The tapered exterior 33 reduces stress concentration.

Body 39 has a downward facing external reaction shoulder 48 located near its upper end. Body 39 has a conventional funnel 49 secured to the lower end. Funnel 49 assists in guiding the body 39 over the wellhead housing 11. Body 39 has a plurality of windows 51 spaced circumferentially around its lower section 39*a*. A locking element, preferably a dog 53, locates at each window 51. Dogs 53 are capable of moving radially inward and outward between a retracted position shown on the right side of FIG. 1 and an engaged position shown on the left side of FIG. 1. Dogs 53 have teeth on their inner faces for engaging the profile 15 when in the engaged position.

A cam ring 55 serves as means for moving the dogs 53 between the retracted and engaged positions. Cam ring 55 will move downward from the upper position shown in the right side of FIG. 1 to the lower position shown in the left side of FIG. 1. Cam ring 55 has an external lifting shoulder 57 for upward movement if the body 39 is to removed from wellhead housing 11. A skirt 59 depends downward from the exterior of cam ring 55 to inhibit the entry of sea water.

A seal sub 61 connects the bore of the casing hanger 21 to passage 35 of stress joint 23 when the stress joint 23 is installed on wellhead housing 11. Seal sub 61 is a tubular member having an axial passage 63. Seals 65 on its upper end engage counterbore 37. Seals 67 on the lower end engage the bore of casing hanger 21. A bracket 69 bears against a shoulder on seal sub 61 and bolts to the lower end of stress joint 23 to retain seal sub 61 in the counterbore 37 of stress joint 23. Seal sub 61 does not contact body 39.

Figure 2:
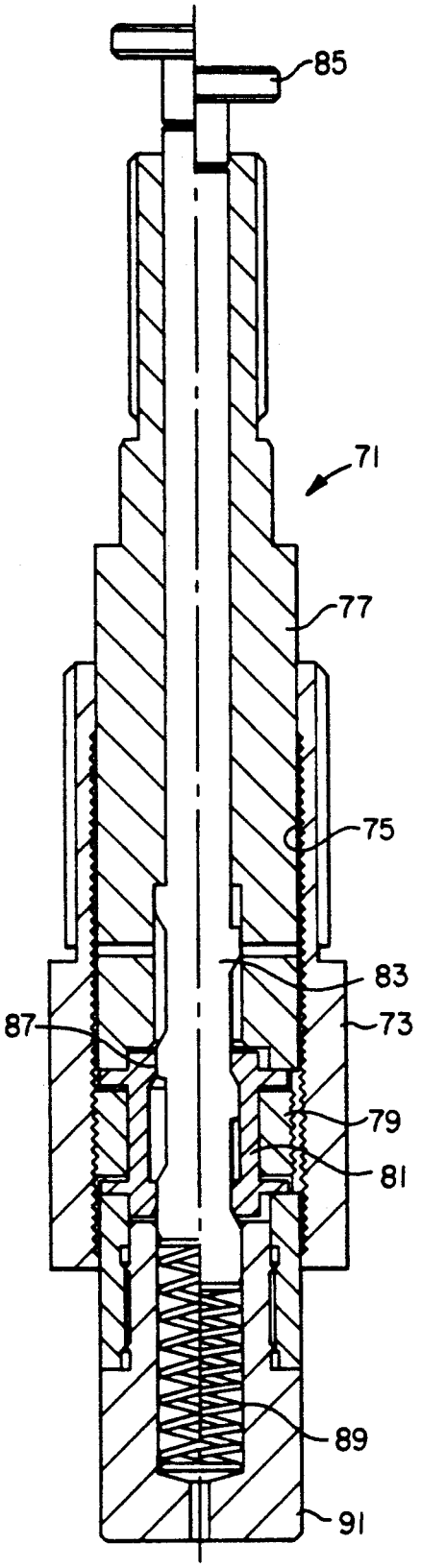
FIG. 2 is an enlarged sectional view of a locking assembly used with the wellhead connector of FIG. 1, showing on the left an engaged position, and on the right a disengaged position.

A plurality of conventional lock assemblies 71 (only one shown) are spaced circumferentially around cam ring 55 to lock the cam ring 55 in the lower position. Referring to FIG. 2, each lock assembly 71 includes a sleeve 73 mounted stationarily in the upper end of funnel 49. Sleeve 73 has a plurality of internal teeth or grooves 75. A body 77 is carried in sleeve 73 and is rigidly secured to cam ring 55 by means of nut 78 (FIG. 1). Body 77 will thus move up and down with cam ring 55, into and out of sleeve 73.

A plurality of dogs 79 are mounted to spring collet 81 within body 77. Dogs 79 have teeth for engaging teeth 75. A mandrel 83 will slide vertically within body 77 for actuating dogs 79. Mandrel 83 has an anvil 85 on its upper end to push mandrel 83 downward. Mandrel 83 has cams 87 on its exterior which will push outward on collet 81 to move the dogs 79 to the engaged position shown on the left side of FIG. 2.

A coil spring 89 locates at the lower end of mandrel 83 to urge it to an upper position. In the upper position, cams 87 will maintain dogs 79 in the locked position. Spring 89 is carried in a retainer 9 which secures by threads to the lower end of body 77.

Figure 3:
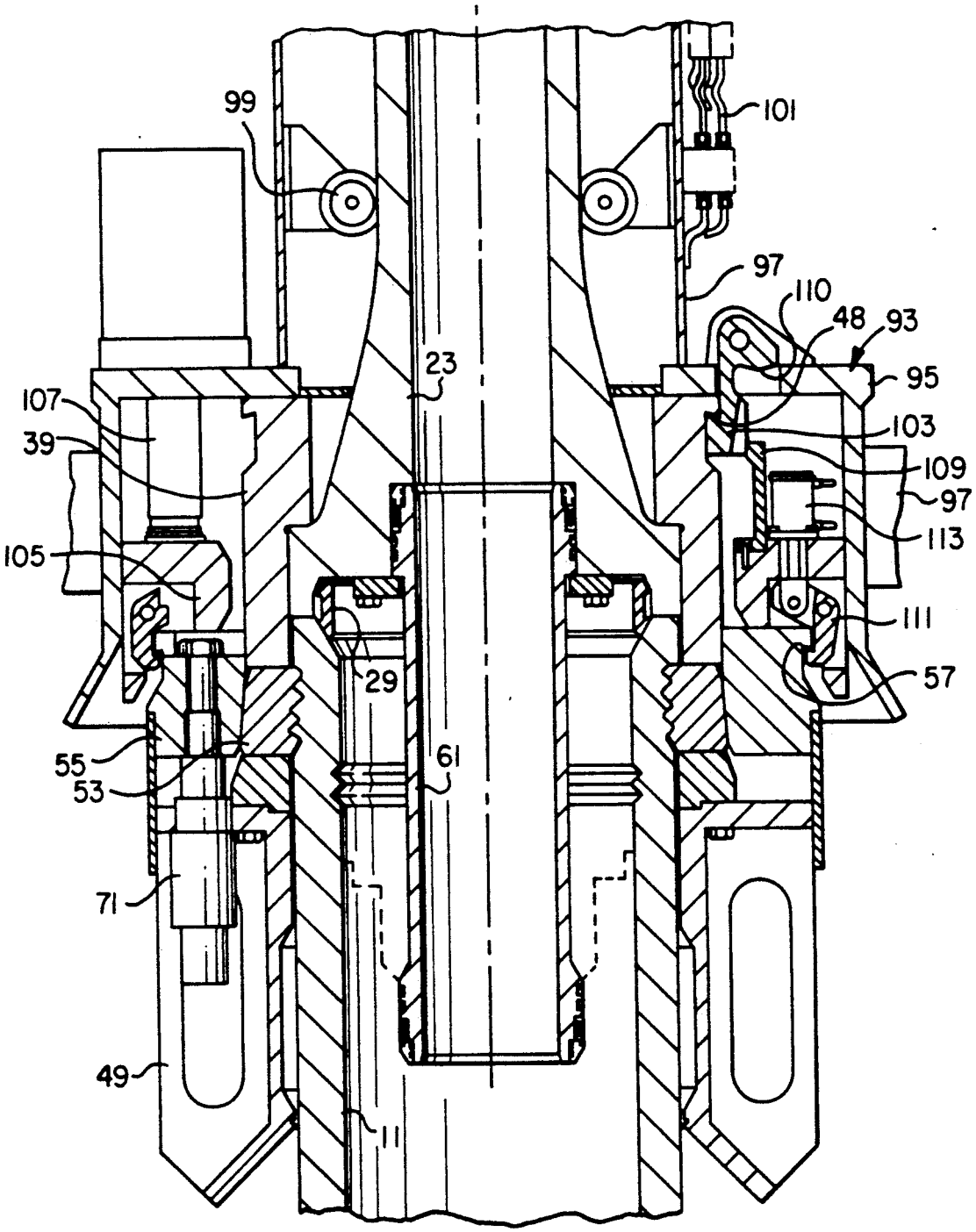
FIG. 3 is a view of the wellhead connector of FIG. 1, and also showing a running tool, with the left side being shown engaged, and the right side in the process of retracting to a disengaged position.

FIG. 3 illustrates a running tool 93 for installing the connection assembly. Running tool 93 has a housing 95 that encircles and is supported on body 39. Guideline supports 97 (only partially shown) extend outward for receiving guidelines (not shown) extending from the subsea well to the platform. Guide rollers 99 will engage the riser and the stress joint 23 to support the running tool 93 when it is retrieved and when it is lowered on the riser. Hydraulic lines 101 extend downward from the platform for supplying hydraulic fluid to running tool 93.

Running tool 93 has a plurality of pivotal reaction arms 103 spaced around its housing 95, each for engaging the body reaction shoulder 48. Each reaction arm 103 has an upward facing lip which mates with the downward facing reaction shoulder 48. Running tool 93 has a compressive load member 105, which is an annular ring carried within housing 95. Load member 105 contacts the upper surface of cam ring 55 to push it downward to the engaged position. A plurality of hydraulic pistons and cylinders 107 (only one shown) mount between the upper side of housing 95 and load member 105 for moving load member 105 downward relative to housing 95.

Figure 4:
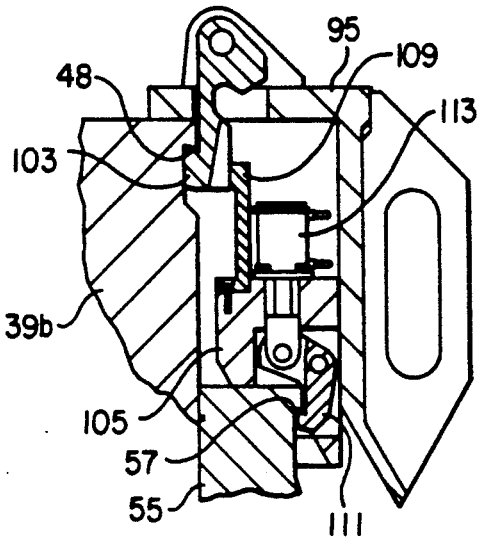
FIG. 4 is a partial sectional view of the wellhead connector running tool as shown in FIG. 3, and showing the reacting and lifting arms in engaged positions.
Figure 5:
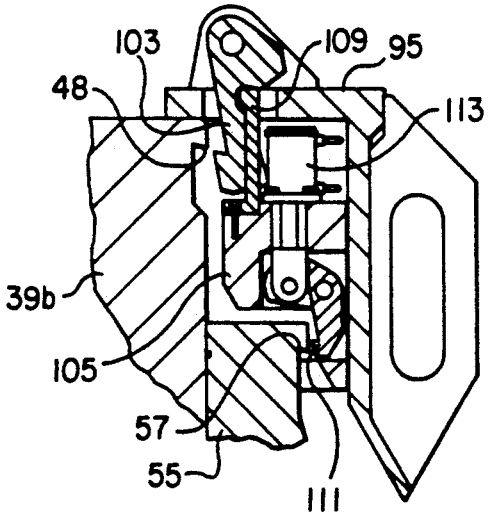
FIG. 5 is a partial view of the running tool for the wellhead connector as shown in FIG. 3, and showing the reacting and lifting arms in disengaged positions.

A cam member 109 mounts to the load member 105. Cam member 109 extends upward and is positioned to engage the reaction arm 103. When cam member 109 is in the lower position shown on the right side of FIG. 3, as also illustrated in FIG. 4, it will force the reaction arm 103 inward to engage the reaction shoulder 48. When hydraulic cylinder 107 moves the load member 105 upward, the cam member 109 will contact a shoulder 110 on reaction arm 103 to cause reaction arm 103 to pivot back to the disengaged position shown in FIG. 5.

Running tool 93 has a plurality of lifting arms 111 for lifting cam member 109 to disengage the dogs 53 if the wellhead connector is to be removed. Lifting arms each have upward facing lips for engaging lifting shoulder 57 on cam ring 55, as shown in FIG. 4. Each lifting arm 111 is pivotally mounted to load member 105. A hydraulic piston and cylinder 113 will move each lifting arm between the retracted and engaged positions.

In operation, the body 39 will be installed on the stress joint 23. Running tool 93 will be placed on the body 39. The load member 105 will be in a lower position with reaction arms 103 engaging reaction shoulders 48. The load member 105 will be in contact with the upper surface of cam ring 55. The lifting arms 111 not be engaging the lifting shoulders 57 of cam ring 55. The stress joint 23 will be secured to the riser and the entire assembly lowered into the sea as the sections of the riser are assembled.

The guide funnel 49 will be lowered over the wellhead housing 11. The downward facing shoulder 25 of stress joint 23 will abut the rim 17 of wellhead housing 11. The seal sub 61 will extend into the bore of casing hanger 21. The operator then will apply hydraulic fluid pressure to hydraulic piston and cylinders 107. This causes load member 105 to move downward, pushing cam ring 55 downward. The downward force imposed by load member 105 is reacted through reaction shoulder 48 in body 39. Cam ring 55 wedges dogs 53 inward into tight engagement with the grooved profile 15. The downward inclined flanks of profile 15 cause the body 39 to pull downward as the dogs 53 engage profile 15. This downward force is transmitted to stress joint 23 through the engagement of the shoulders 31, 41. This compressive force is applied to energize seal 29.

As the cam ring 55 moves downward, it will move the body 77 of lock assembly 71, as shown in FIG. 2. Body 77 will align in sleeve 73. The load member 105 will be in contact With anvil 85, maintaining mandrel 83 in a lower position relative to body 77. The dogs 79 will be retracted.

Once cam ring 55 is in the lower position, the operator will then reverse hydraulic cylinders 107 to move load member 105 upward. This allows mandrel 83 to spring upward due to spring 89 (FIG. 2). Dogs 79 will spring out and engage sleeve 73. This prevents cam ring 55 from any further upward movement. The cam member 109 will contact the shoulder 110 of reaction arm 103, causing the reaction arm 103 to retract to the position shown in FIG. 5. The operator may then retrieve the running tool 93 to the surface platform.

If it is desired at a later time to disconnect the stress joint 23 from wellhead housing 11, the operator lowers running tool 93 back into the position shown in FIG. 3. The operator actuates hydraulic cylinders 107 to move load member 1? 5 downward. Load member 105 will push mandrel 83 downward, retracting dogs 79 (FIG. 2). Hydraulic cylinders 113 will be actuated to cause lifting arm 103 to engage lifting shoulder 57, as shown in FIGS. 3 and 4. The operator then reverses hydraulic cylinders 107 to lift load member 105. Cam ring 55 will move upward with load member 105. Dogs 53 are free to retract. The operator will then retrieve running tool 93. The operator will then lift the riser to retrieve stress joint 23, bringing with it the body 39.

The invention has significant advantages. The connector assembly is simpler, lighter and requires fewer seals than the prior art type. The assembly requires no tension bolts connected between the stress joint and the body.

While the invention has been shown in only one of its forms, it should be apparent to those skilled in the art that it is not so limited, but is susceptible to various changes without departing from the scope of the invention.

We claim:

1. In a subsea well having a wellhead housing of a type having an external grooved profile, an upper rim, and a longitudinal axis, a connector assembly for connecting the wellhead housing to a riser, comprising in combination:

a stress joint adapted to be connected to the riser, having a downward facing shoulder which is adapted to abut the upper rim of the wellhead housing, the stress joint having an external upward facing shoulder;

a seal located at the downward facing shoulder of the stress joint for engaging the upper rim of the stress joint to seal the stress joint to the wellhead housing;

a body having a lower cylindrical section which is adapted to extend over the wellhead housing, the body having an internal downward facing shoulder which abuts the upward facing shoulder of the wellhead housing;

a locking member mounted to the body for radial movement between a retracted position spaced outward from the grooved profile and an engaged position adapted to engage the grooved profile; and a cam ring mounted to the body in engagement with the locking member and for axial movement relative to the body to move the locking member between the retracted position and the engaged position, the locking member when in the engaged position exerting a downward force on the body which in turn pushes downward on the upward facing shoulder of the stress joint to exert a compressive force on the upper rim of the wellhead housing.

2. The connector assembly according to claim 1 wherein the cam ring has an upward facing surface adapted to be engaged by a running tool to push the cam ring downward.

3. The connector assembly according to claim wherein the cam ring has an external downward facing shoulder adapted to be engaged by a running tool to pull the cam ring upward.

4. The connector assembly according to claim wherein:

the cam ring has an upward facing surface adapted to be engaged by a running tool to push the cam ring downward and has an external downward facing lifting shoulder adapted to be engaged by the running tool to pull the cam ring upward; and wherein the body has an external downward facing reaction shoulder adapted to be engaged by the running tool when the running tool is pushing downward on the cam ring.

5. The connector assembly according to claim 1 wherein the stress joint and the wellhead housing each has an axial passage, wherein a casing hanger having an axial bore is mounted in the axial passage of the wellhead housing, and wherein the connector assembly further comprises:

a seal sub mounted to a lower side of the stress joint in fluid communication with the axial passage in the stress joint and having a lower end adapted to sealingly extend into the bore of the casing hanger, the seal sub being free of any contact with the body to eliminate the need to seal between the seal sub and the body.

6. The connector assembly according to claim 1 wherein the stress joint and the wellhead housing each has an axial passage, wherein a casing hanger having an axial bore is mounted in the axial passage of the wellhead housing, and wherein the connector assembly further comprises:

a seal sub having an upper end sealingly mounted in the counterbore of the stress joint and having a lower end adapted to sealingly extend into the bore of the casing hanger, the seal sub being free of any contact with the body to eliminate the need to seal between the seal sub and the body.

7. A subsea well of a type which connects to a string of riser extending upward to a platform, comprising in combination:

a wellhead housing having an external grooved profile, an upper rim, and a passage with a longitudinal axis;

a casing hanger supported in the passage of the wellhead housing and having a bore;

a stress joint adapted to connected to a lower end of the riser, having an axial passage and a downward facing shoulder which abuts the upper rim of the wellhead housing;

a seal located at the upper rim of the wellhead housing and the downward facing shoulder of the stress joint for sealing the passage of the stress joint to the passage of the wellhead housing;

a body carried by the stress joint and having a lower cylindrical section which extends over an upper portion of the wellhead housing;

a plurality of windows in the lower cylindrical section of the body;

a plurality of locking members, each mounted to the body in one of the windows for radial movement between a retracted position spaced outward from the grooved profile and an engaged position in engagement with the grooved profile;

a cam ring mounted to the body in engagement with the locking members and adapted to be contacted by a running tool for downward movement relative to the body to move the locking members from the retracted position to the engaged position;

a reaction shoulder formed on the exterior of the body and adapted to be engaged by the running tool for reacting against downward force imposed by the running tool on the cam ring;

a downward facing lifting shoulder formed on the exterior of the cam ring and adapted to be engaged by the running tool for moving the cam ring upward to allow the locking members to retract for removal of the stress joint; and a seal sub sealingly mounted to a lower side of the stress joint in fluid communication with the axial passage in the stress joint and having a lower end sealingly extending into the bore of the casing hanger, the seal sub being free of any contact with the body to eliminate the need to seal between the seal sub and the body.

8. The subsea well according to claim 7 wherein the axial passage of the stress joint has a counterbore at its lower end, and wherein the seal sub extends sealingly into the counterbore.

9. A subsea well of a type which connects to a string of riser extending upward to a platform, comprising in combination:

a wellhead housing having an external grooved profile, an upper rim, and a passage with a longitudinal axis;

a stress joint adapted to be connected to a lower end of the riser, having an axial passage, a downward facing shoulder which abuts the upper rim of the wellhead housing, and an external upward facing shoulder;

a seal located at the upper rim of the wellhead housing and the downward facing shoulder of the stress joint for sealing the passage of the stress joint to the passage of the wellhead housing;

a body having a lower cylindrical section which extends over an upper portion of the wellhead housing, the body having an upper cylindrical section which fits over a portion of the stress joint and which has an internal downward facing shoulder which abuts the upward facing shoulder of the stress joint;

a plurality of windows in the lower cylindrical section of the body;

a plurality of locking members, each mounted to the body in one of the windows for radial movement between a retracted position spaced outward from the grooved profile and an engaged position in engagement with the grooved profile;

a cam ring mounted to the body in engagement with the locking members for downward movement relative to the body to move the locking members from the retracted position to the engaged position, the locking members when in the engaged position exerting a downward force on the body which in turn pushes downward on the upward facing shoulder of the stress joint to exert a compressive force on the upper rim of the wellhead housing;

running tool means for exerting a downward force on the cam ring to move the cam ring downward relative to the body and for lifting the cam ring if removal of the stress joint is desired;

a reaction shoulder formed on the exterior of the body and adapted to be engaged by the running tool means for reacting against downward force imposed by the running tool on the cam ring; and a downward facing lifting shoulder formed on the exterior of the cam ring and adapted to be engaged by the running tool means for moving the cam ring upward to allow the locking members to retract for removal of the stress joint.

10. The subsea well according to claim 9 further comprising:

a casing hanger supported in the passage of the wellhead housing and having a bore; and a seal sub sealingly mounted to a lower side of the stress joint in fluid communication with the axial passage in the stress joint and having a lower end sealingly extending into the bore of the casing hanger, the seal sub being free of any contact with the body to eliminate the need to seal between the seal sub and the body.

11. The subsea well according to claim 9 wherein:

the stress joint tapers upward from the upward facing shoulder; and wherein the upper cylindrical section of the body has a cylindrical inner wall extending upward from the downward facing shoulder of the upper cylindrical section, defining an annular conical clearance between the stress joint and the body above the upward facing shoulder of the stress joint.

12. The subsea well according to claim 9 wherein the reaction shoulder is located above the lifting shoulder.

13. A connector assembly and running tool for connecting a riser to a subsea well having a wellhead housing of a type having an external grooved profile, an upper rim having an inner conical bevel, and a passage with a longitudinal axis, the connector assembly comprising in combination:

a stress joint adapted to be connected to the riser, having an axial passage, a downward facing shoulder at the lower end of the axial passage which is adapted to abut the upper rim of the wellhead housing, the lower end of the axial passage having a conical bevel, the stress joint having an external upward facing shoulder;

a seal located at the bevel of the axial passage of the stress joint and adapted to engage the bevel of the upper rim of the wellhead housing for sealing the axial passage of the stress joint to the passage of the wellhead housing;

a body having a lower cylindrical section which is adapted to extend over an upper portion of the wellhead housing, the body having an upper cylindrical section which fits over a portion of the stress joint and which has an internal downward facing shoulder which abuts the upward facing shoulder of the stress joint;

a plurality of windows in the lower cylindrical section of the body;

a plurality of locking members, each mounted to the body in one of the windows for radial movement between a retracted position spaced outward from the grooved profile and an engaged position adapted to engage the grooved profile;

a cam ring mounted to the body in engagement with the locking members for downward movement relative to the body to move the locking members from the retracted position to the engaged position, the locking members when in the engaged position exerting a downward force on the body which in turn pushes downward on the upward facing shoulder of the stress joint to exert a compressive force on the upper rim of the wellhead housing;

a downward facing reaction shoulder formed on the exterior of the body;

a downward facing lifting shoulder formed on the exterior of the cam ring;

the running tool comprising in combination:

a reaction arm which engages the reaction shoulder, a compressive load member which contacts an upper surface of the cam ring, and a lifting arm which engages the lifting shoulder of the cam ring; and means in the running tool for moving the compressive load member downward to exert a downward force on the upper surface of the cam ring while reacting the downward force through the reaction arm to the reaction shoulder to cause the cam ring to move the locking members to the engaged position, and for moving the lifting arm upward to move the cam ring upward to move the locking members to the retracted position for removing the stress joint from the wellhead housing.

14. The connector assembly and running tool according to claim 13 wherein the subsea well has a casing hanger supported in the passage of the wellhead housing and having a bore, and wherein the connector assembly further comprises:

a seal sub sealingly mounted to a lower side of the stress joint in fluid communication with the axial passage in the stress joint and having a lower end adapted to sealingly extend into the bore of the casing hanger, the seal sub being free of any contact with the body to eliminate the need to seal between the seal sub and the body.

15. The connector assembly according to claim 13 wherein:

the stress joint tapers upward from the upward facing shoulder; and wherein the upper cylindrical section of the body has a cylindrical inner wall extending upward from the downward facing shoulder of the upper cylindrical section, defining an annular conical clearance between the stress joint and the body above the upward facing shoulder of the stress joint.

16. A method of connecting a riser to a subsea well having a wellhead housing of a type having an external grooved profile, an upper rim, and a longitudinal axis, comprising:

mounting a stress joint to a lower end of the riser, and providing the stress joint with a downward facing shoulder and an external upward facing shoulder;

placing a seal on the downward facing shoulder;

providing a body with a lower cylindrical section and an internal downward facing shoulder;

placing the body over the stress joint with the downward facing shoulder of the body contacting the upward facing shoulder of the stress joint;

mounting a locking member to the lower cylindrical section of the body for radial movement between a retracted position and an engaged position mounting a cam ring to the body in engagement with the locking member for axial movement relative to the body;

lowering the stress joint onto the wellhead housing and the body over the wellhead housing, and causing the downward facing shoulder of the stress joint to abut the upper rim; then axially moving the cam ring to move the locking member to the engaged position in engagement with the profile, causing the locking member to exert a downward force on the body which in turn pushes downward on the upward facing shoulder of the stress joint to exert a compressive force on the upper rim of the wellhead housing and on the seal.

* * * * *

UNITED STATES PATENT AND TRADEMARK OFFICE

CERTIFICATE OF CORRECTION

PATENT NO. : 5,255,743

DATED : 10/26/93

INVENTOR(S) : Leslie J. Adam, et al.

It is certified that error appears in the above-identified patent and that said Letters Patent is hereby corrected as shown below:

At column 5, line 11, "With" should be --with--;

At column 5, line 28, "1? 5" should be --105--.

Signed and Sealed this

Nineteenth Day of July, 1994

*Attest:*

*Attesting Officer*

BRUCE LEHMAN

*Commissioner of Patents and Trademarks*